US011168643B2

(12) United States Patent
Lineton et al.

(10) Patent No.: US 11,168,643 B2
(45) Date of Patent: Nov. 9, 2021

(54) COATING TO REDUCE COKING DEPOSITS ON STEEL PISTONS

(71) Applicant: FEDERAL-MOGUL LLC, Southfield, MI (US)

(72) Inventors: Warran Boyd Lineton, Chelsea, MI (US); Timothy Christopher Vezina, Northville, MI (US)

(73) Assignee: Tenneco Inc., Lake Forest, IL (US)

( * ) Notice: Subject to any disclaimer, the term of this patent is extended or adjusted under 35 U.S.C. 154(b) by 224 days.

(21) Appl. No.: 15/901,783

(22) Filed: Feb. 21, 2018

(65) Prior Publication Data

US 2019/0257265 A1 Aug. 22, 2019

(51) Int. Cl.

| | |
|---|---|
| ***F02F 3/12*** | (2006.01) |
| ***F02F 3/16*** | (2006.01) |
| ***F02F 3/10*** | (2006.01) |

(52) U.S. Cl.

CPC ..... *F02F 3/12* (2013.01); *F02F 3/10* (2013.01); *F02F 3/16* (2013.01); *F05C 2225/04* (2013.01); *F05C 2253/12* (2013.01)

(58) Field of Classification Search

CPC ..... F02F 3/12; F02F 3/10; F02F 3/16; F02F 3/0015; F02F 3/003; F02F 3/0084; F16J 1/005; F16J 1/01; F05C 2225/04; F05C 2253/12

See application file for complete search history.

(56) References Cited

U.S. PATENT DOCUMENTS

| | | | | |
|---|---|---|---|---|
| 2,817,562 | A * | 12/1957 | Fleming | F02F 3/10 92/155 |
| 4,645,440 | A | 2/1987 | Murata et al. | |
| 5,063,894 | A * | 11/1991 | Mielke | F02F 3/10 123/193.6 |
| 5,154,109 | A * | 10/1992 | Fluga | F15B 15/1447 29/888.046 |
| 5,435,872 | A | 7/1995 | Penrice | |
| 5,435,873 | A | 7/1995 | Penrice | |

(Continued)

FOREIGN PATENT DOCUMENTS

| | | | |
|---|---|---|---|
| DE | 102011107659 | A1 | 1/2013 |
| DE | 102014211366 | A1 | 12/2014 |

(Continued)

OTHER PUBLICATIONS

International Search Report, dated May 9, 2019 (PCT/US2019/018884).

*Primary Examiner* — Grant Moubry
(74) *Attorney, Agent, or Firm* — Robert L Stearns; Dickinson Wright, PLLC

(57) ABSTRACT

A piston for an internal combustion engine is provided. The piston includes a coating applied to a ferrous body portion to reduce or prevent chemical bonding of carbon deposits or coking on the body portion at temperatures ranging from 200 to 400° C. The coating includes a fluoropolymer, such as polytetrafluoroethylene, fluorosilane, fluorocarbon, fluoroplastic resin, and/or perfluoroplastic, and may be hydrocarbon or silicone based. The coating also has a thickness of 25 microns to 1 millimeter. The coating can be disposed on an undercrown surface, ring grooves, ring lands, pin bosses, and/or skirt sections of the body portion.

14 Claims, 2 Drawing Sheets

(56) References Cited

U.S. PATENT DOCUMENTS 5,490,445 A * 2/1996 Rao ..... F16J 1/08 123/193.6
5,713,324 A 2/1998 Frame et al.
6,145,763 A 11/2000 Fleming et al.
6,495,267 B1 * 12/2002 Schenkel ..... C25D 11/30 29/888.044
7,383,806 B2 6/2008 Abi-Akar et al.
7,866,295 B2 1/2011 Shi et al.
8,220,433 B2 * 7/2012 Sasaki ..... C10M 111/04 123/193.6
8,574,704 B2 11/2013 Smith et al.
8,789,509 B2 * 7/2014 Sasaki ..... C10M 111/04 123/193.6
9,163,579 B2 * 10/2015 Aharonov ..... F02F 3/10
9,670,870 B2 * 6/2017 Bischofberger ... B22D 19/0009
9,903,310 B2 * 2/2018 Bieneman ..... F02F 3/14
9,945,480 B2 * 4/2018 Kantola ..... F16J 1/006
10,352,269 B2 * 7/2019 Ikai ..... F16J 1/01
10,487,773 B2 * 11/2019 Taguchi ..... C25D 11/10
2003/0051714 A1 * 3/2003 Bedwell ..... F02F 3/10 123/670
2004/0224856 A1 11/2004 Saiki et al.
2006/0054127 A1 3/2006 Kamada et al.
2007/0113802 A1 * 5/2007 Mihara ..... F16J 1/01 123/41.35
2008/0163751 A1 * 7/2008 Subramanian ..... F16J 1/02 92/223
2008/0167403 A1 7/2008 Burkle
2010/0251886 A1 * 10/2010 Fussner ..... F02F 3/105 92/223
2010/0294230 A1 * 11/2010 Raj ..... C10M 171/06 123/196 AB
2013/0014723 A1 1/2013 Bucher
2013/0133609 A1 * 5/2013 Matsuo ..... F02F 3/22 123/193.6
2014/0123930 A1 * 5/2014 Lineton ..... F02F 3/16 123/193.6
2014/0196439 A1 * 7/2014 Dolan ..... C25D 9/12 60/274
2015/0064376 A1 3/2015 Smith et al.
2015/0204233 A1 * 7/2015 Nanba ..... F02F 1/18 123/668
2016/0138516 A1 5/2016 Moding
2016/0273484 A1 * 9/2016 Tateno ..... C25D 11/04
2017/0122147 A1 * 5/2017 Dolan ..... F01L 3/04
2017/0335792 A1 * 11/2017 Matsuo ..... C23C 30/00
2019/0063604 A1 2/2019 Taresawa et al.

FOREIGN PATENT DOCUMENTS

EP 1469050 A1 10/2004
EP 2096290 A1 9/2009
JP 57179354 A * 11/1982 ..... F02F 3/22
JP H0457650 U 5/1992
JP 2006045463 A 2/2006
JP 2006112422 A 4/2006
JP 2014034917 A 2/2014
WO 9513191 A1 5/1995
WO 2017168655 A1 10/2017
WO 2017201354 A1 11/2017

* cited by examiner

COATING TO REDUCE COKING DEPOSITS ON STEEL PISTONS

BACKGROUND OF THE INVENTION

1. Field of the Invention

This invention relates generally to pistons for internal combustion engines, and methods of manufacturing the same.

2. Related Art

Modern heavy duty diesel engines are being pushed towards increased efficiency under emissions and fuel economy legislation. To achieve greater efficiency, the engines must run at higher temperatures. For example, some internal combustion engines are being designed to run hotter, and some types of steel pistons are designed to run at temperatures 100 to 250° C. hotter than standard pistons in some zones.

However, while desirable to increase the temperature within the combustion chamber, it remains necessary to maintain the piston at a workable temperature. As such, it is known to incorporate outer and inner cooling galleries, both open and closed, within the piston head through which engine oil is circulated to reduce the operating temperature of the piston head. The outer cooling galleries typically circulates about an upper land of the piston including a ring groove region while the inner cooling gallery is typically beneath an upper combustion surface of the piston head, commonly referred to as undercrown. Alternatively, the piston can have a galleryless design and thus has an open undercrown region for exposure to cooling oil. Both the ring belt region and the undercrown surface benefit from cooling action of the circulated oil. However, over time the circulated oil begins to degrade and oxidize. The oxidation is driven by heating of the oil due to contact with the high temperature piston surfaces, and thus, deposits can form on the surfaces of the piston, also referred to as coking. The increased temperatures of the pistons during operation contributes to the risk of increased coking, especially in the undercrown and land regions of the piston. As the deposit build-up continues, an insulation layer is formed on the respective surfaces. Due to the coking deposits, the cooling effects of the circulated oil can be diminished, which in turn leads to combustion bowl surface oxidation and erosion, as well as over tempering of the surface. As such, the mechanical properties of the piston material are diminished, which can lead to crack formation.

SUMMARY

One aspect of the invention provides a piston for an internal combustion engine which includes a coating for mitigating, reducing, or avoiding carbon deposits or coking during operation of the piston in the engine. The piston includes a body portion formed of a ferrous material, and the coating is disposed on the body portion. The body portion includes a crown presenting a combustion surface and an undercrown surface, and a ring belt region depending from the combustion surface. The body portion also includes a pair of pin bosses depending from the crown and spaced from one another by a pair of skirt sections. The coating includes a fluoropolymer and has a thickness of 25 microns to 1 millimeter.

Another aspect of the invention provides a method of manufacturing a piston. The method includes the steps of: providing a body portion formed of a ferrous material. The body portion includes a crown presenting a combustion surface and an undercrown surface, and a ring belt region depending from the combustion surface. The body portion also includes a pair of pin bosses depending from the crown and spaced from one another by a pair of skirt sections. The method further includes disposing a coating on the body portion. The coating includes a fluoropolymer and has a thickness of 25 microns to 1 millimeter.

BRIEF DESCRIPTION OF THE DRAWINGS

These and other advantages of the present invention will be readily appreciated, as the same becomes better understood by reference to the following detailed description when considered in connection with the accompanying drawings wherein.

DETAILED DESCRIPTION OF EXEMPLARY EMBODIMENTS

Figure 1:
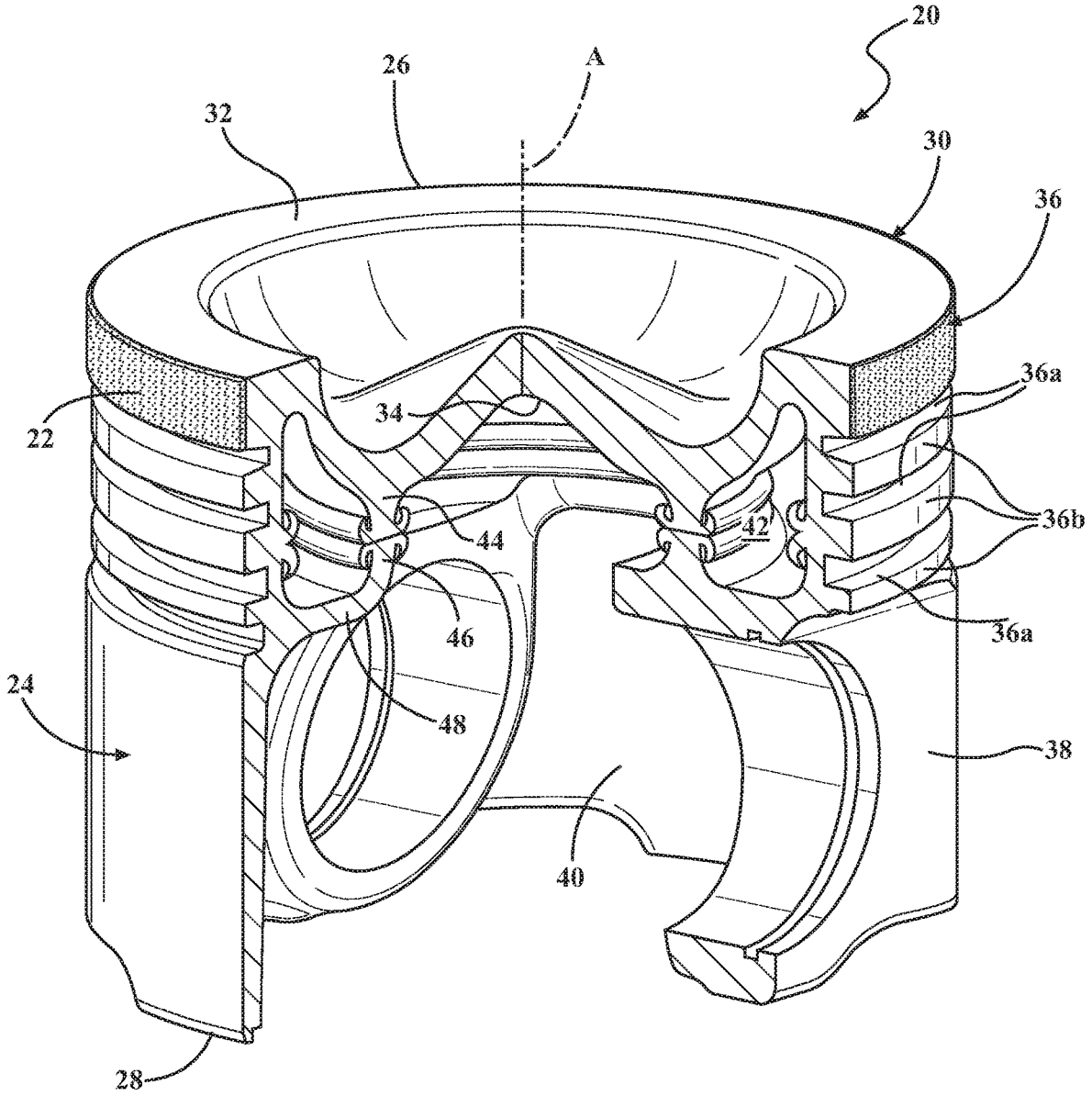
FIG. 1 is a perspective sectional view a gallery-containing diesel engine piston including a coating applied to the crown according to an example embodiment.
Figure 2:
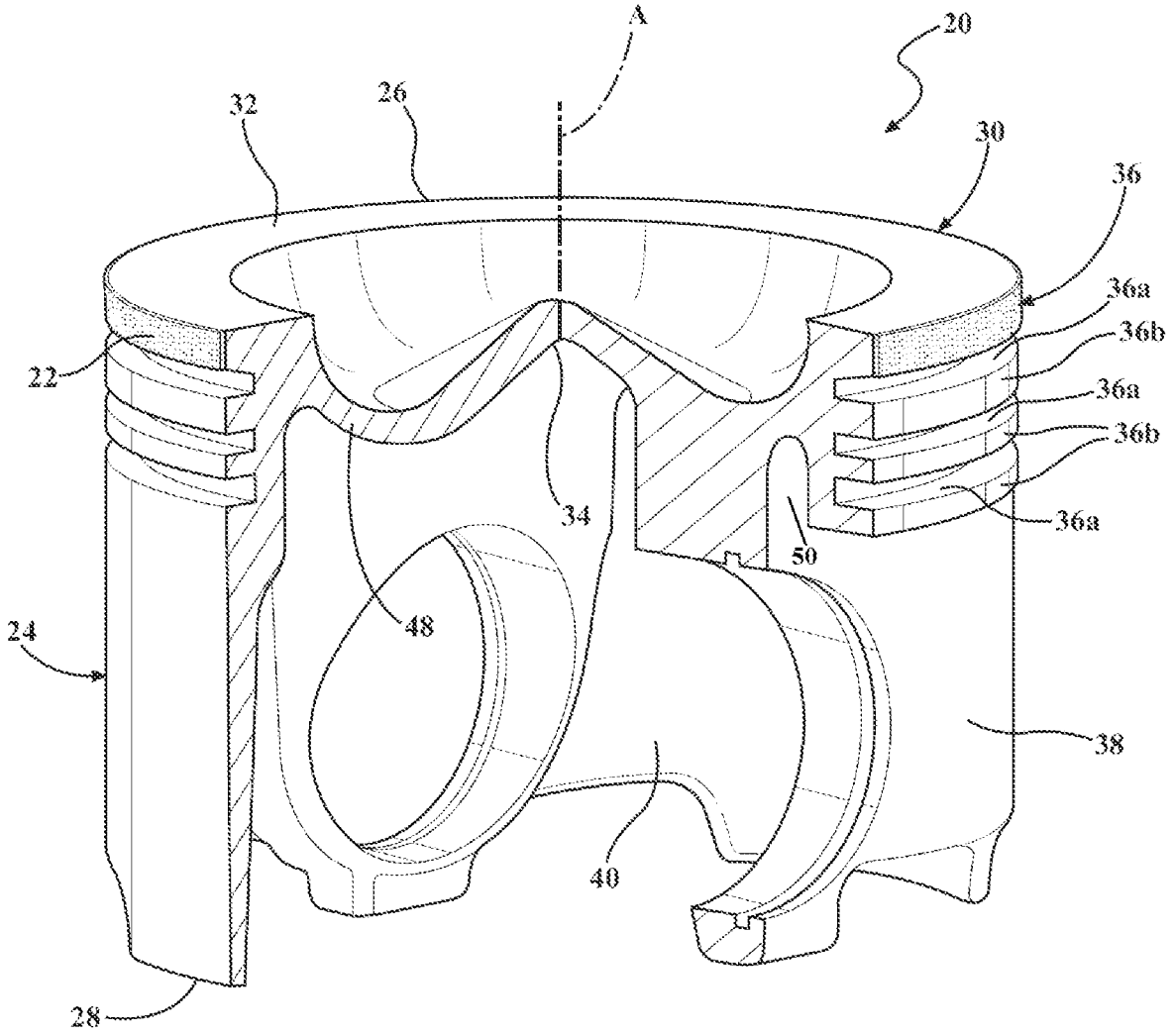
FIG. 2 is a perspective sectional view of a galleryless diesel engine piston including the coating applied to the crown according to another example embodiment.

One aspect of the invention provides a piston 20 with a coating 22 for use in an internal combustion engine, such as a heavy duty diesel engine or alternatively a gasoline engine. The coating 22 reduces or avoids coking deposits during operation of the piston 20 in the engine at temperatures ranging from 200 to 400° C. Thus, the piston 20 can provide for improved cooling effects of the circulated oil, which in turn leads to reduced surface oxidation and erosion, as well as reduced tempering of the surface. As such, the mechanical properties of the piston 20 are improved, and crack formation is reduced. Examples of the piston 20 are shown in FIGS. 1 and 2. However, the coating 22 can be applied to pistons having other designs.

According to the example embodiments of FIGS. 1 and 2, the piston 20 includes a body portion 24 formed of a ferrous material, such as steel or another iron-based material. The body portion 24 extends around a center axis A and longitudinally along the center axis A from an upper end 26 to a lower end 28. The body portion 24 includes a crown 30 presenting a combustion surface 32 at the upper end 26 for exposure to a combustion chamber of the internal combustion engine. The combustion surface 32 includes a combustion bowl extending toward the center axis A from an outer rim and includes an apex at the center axis A. The crown 30 also includes an undercrown surface 34 located opposite the combustion surface 32 which is typically exposed to cooling oil or another cooling medium.

The body portion 24 further includes a ring belt region 36 depending from the combustion surface 32. The ring belt region 36 includes a plurality of ring grooves **36*a* spaced from one another by lands 36*b*. The ring belt region 36 is located at an outer diameter of the body portion 24 and extends circumferentially about the center axis A of the body portion 24**.

The body portion 24 further includes a pair of pin bosses 38 depending from the crown 30 and spaced from one another by a pair of skirt sections 40. The pin bosses 38 and the skirt sections 40 extend from the crown 30 to the lower end 28, and the pin bosses 38 define a pin bore for receiving a wrist pin (not shown).

According to the example embodiment of FIG. 1, the body portion 24 of the piston 20 includes a closed or sealed cooling gallery 42 extending circumferentially around the center axis A between the crown 30 and a lower section of the body portion 24. The lower section of the body portion 24 includes at least a portion of the ring belt region 36, the pin bosses 38, and the skirt sections 40. In this embodiment, the crown 30 includes an upper rib 44 spaced from the center axis A and extending circumferentially around the center axis A. The lower section of the body portion 24 includes a lower rib 46 aligned with the upper rib 44 and extending circumferentially around the center axis A. The upper rib 44 and the lower rib 46 are joined, typically by welding, for example friction welding and/or laser welding. The lower section of the body portion 24 also includes a lower wall 48 extending radially from the lower rib 46 to the ring belt region 36. As shown in FIG. 1, the cooling gallery 42 extends circumferentially around the center axis A of the body portion 24 and defined by the ring belt region 36, the ribs, the undercrown surface 34, and the lower wall 48.

According to the example embodiment of FIG. 2, the body portion 24 of the piston 20 is galleryless. Thus, the undercrown surface 34 is openly exposed and not bounded by a sealed or enclosed cooling gallery 42. The undercrown surface 34 is located both opposite the combustion surface 32 and radially inwardly of the ring grooves 36α. The undercrown surface 34 includes a center region disposed at the center axis A and between the pin bosses 38 and the skirt sections 40, which is open for exposure to cooling oil. The undercrown surface 34 also includes pockets 50 disposed between the pin bosses 38 and the ring belt region 36, which are also open for exposure to cooling oil.

The coating 22 of the piston 20 is disposed on at least a portion of the ferrous body portion 24. For example, the coating 22 is disposed on at least one of the undercrown surface 34, at least one of the ring grooves 36*a*, at least one of the lands 36*b*, at least one of the pin bosses 38, and at least one of the skirt sections 40. In the example embodiments of FIGS. 1 and 2, the coating 22 is disposed on an uppermost land 36*b* of the crown 30. However, the coating 22 could be located on another other section of the body portion 24. The coating 22 is applied when the piston 20 is otherwise in the finished condition.

As stated above, the coating 22 reduces or avoids the bonding of the carbon deposits on the body portion 24 of the piston 20, also referred to as coking, during operation of the piston 20 in the engine at service temperatures ranging from 200 to 400° C. The coating 22 includes a fluoropolymer and has a thickness of 25 microns to 1 millimeter. The thickness of the coating 22 is measured after the coating 22 is dried and cured. For example, the fluoropolymer of the coating 22 can include polytetrafluoroethylene (PTFE), fluorosilane, fluorocarbon, fluoroplastic resin, and/or perfluoroplastic. According to one embodiment, the coating 22 further includes silicone, polysilane, and/or polysilazane, and the coating 22 may be silicone-based. The coating 22 could alternatively be another non-stick formulation which includes a fluoropolymer. For example, the coating 22 could be hydrocarbon based. In another embodiment the coating 22 includes a thermoset binder. For example, the thermoset can include phenolic, epoxy, polyester, polyamide-imide or any combination of the thermoset resins. The fluoropolymer is added to the uncured thermoset resin(s) and mixed before application to one or more surfaces of the piston 20 followed by curing. Alternatively, the fluoro-polymer can be added to the thermoplastic resin as uncured components and co-polymerized in the curing step of the coating 22. In both methods, the fluoropolymer components segregate to the surface of the coating 22 over time and provide the non-stick effect.

Another aspect of the invention provides a method of manufacturing the piston 20. The method includes providing the body portion 24 formed of a ferrous material. The body portion 24 can include the design described above, or can have a different design.

The method further includes disposing the coating 22 on the body portion 24. The coating 22 includes the fluoropolymer as described above. The step of disposing the coating 22 on the body portion 24 includes disposing the coating 22 on at least one of the following: the undercrown surface 34, at least one ring groove 36*a* of the ring belt region 36, at least one land 36*b* of the ring belt region 36, at least one of the pin bosses 38, and at least one of the skirt sections 40. The coating 22 is preferably applied by spraying, dipping, brushing, ink-jet, rolling, pipetting or transfer stamping.

The coating step is preferably a rapid and atmospheric method. According to an example embodiment, the spraying step is conducted using an airbrush dispenser. The spraying should be capable of directing the coating 22 to specific regions of the body portion 24. The method can also include masking a portion or portions of the body portion 24, to prevent the coating 22 from being applied to that portion or portions, during the spraying step. The method can also include moving the body portion 24 relative to the airbrush dispenser during the spraying step. When manufacturing multiple pistons 20, a part handling and manipulation system can be used to pick and place the body portions 24 and move them appropriately in a spray jet. Alternatively a system of linear axis slides or a robot could manipulate the spray gun relative to the body portion 24. The method next includes drying and curing the coating 22. A convection oven or infrared lamps can be used to dry and/or cure the coating 22. The thickness of the coating 22 is 25 microns to 1 millimeter after the drying and curing steps.

The method of manufacturing the coated piston 20 has no need for vacuum chambers or special atmospheres that would be needed in physical vapor deposition or chemical vapor deposition. Thus, the process of manufacturing the coated piston 20 is a production friendly, minimally invasive process. It can fit with current production methods, and the coating 22 could be applied over the top of a finished phosphated piston. Initial testing conducted in an engine run at full power for 25 hours showed coking deposits on the undercrown of non-coated, standard pistons, but the coated piston 20 run in the same test had the coking deposits significantly reduced (by 66%).

Obviously, many modifications and variations of the present invention are possible in light of the above teachings and may be practiced otherwise than as specifically described while within the scope of the following claims. In particular, all features of all claims and of all embodiments can be combined with each other, as long as they do not contradict each other.

The invention claimed is:

1. A piston, comprising:

a body portion formed of a ferrous material, said body portion including a crown presenting a combustion surface and undercrown surface, a coating disposed on said undercrown surface of said body portion, said coating including a fluoropolymer, said coating including at least one of polysilane and polysilazane, and said coating having a thickness of 25 microns to 1 millimeter.

2. The piston of claim 1, wherein said coating further includes at least one of thermoset resin and silicone.

3. The piston of claim 1, wherein said fluoropolymer of said coating includes polytetrafluoroethylene, fluorosilane, fluorocarbon, fluoroplastic resin, and/or perfluoroplastic.

4. The piston of claim 1, wherein said coating reduces chemical bonding of carbon deposits or coking on said body portion at temperatures ranging from 200 to 400° C.

5. The piston of claim 1, wherein said body portion includes a ring belt region depending from said combustion surface, said body portion includes a pair of pin bosses depending from said crown and spaced from one another by a pair of skirt sections, said coating is disposed on at least one of the following: at least one ring groove of said ring belt region, at least one land of said ring belt region, at least one of said pin bosses, and at least one of said skirt sections.

6. The piston of claim 1, wherein said body portion includes a cooling gallery extending circumferentially around a center axis between said crown and a lower section of said body portion.

7. The piston of claim 6, wherein said body portion includes a ring belt region depending from said combustion surface, said body portion includes a pair of pin bosses depending from said crown and spaced from one another by a pair of skirt sections, said lower section of said body portion includes at least a portion of said ring belt region, said pin bosses, and said skirt sections, said crown includes an upper rib spaced from said center axis and extending circumferentially around said center axis, said lower section of said body portion includes a lower rib aligned with said upper rib and extending circumferentially around said center axis, said upper rib is welded to said lower rib, said lower section of said body portion includes a lower wall extending radially from said lower rib to said ring belt region, and said cooling gallery is defined by said ring belt region, said ribs, said undercrown surface, and said lower surface.

8. The piston of claim 1, wherein said undercrown surface is openly exposed and not bounded by a sealed or enclosed cooling gallery.

9. The piston of claim 8, wherein said undercrown surface includes a center region disposed at said center axis and between said pin bosses and said skirt sections, and said undercrown surface includes pockets disposed between said pin bosses and said ring belt region.

10. The piston of claim 8, wherein said undercrown surface is located opposite said combustion surface and radially inwardly of said ring grooves, said undercrown surface is openly exposed and not bounded by a sealed or enclosed cooling gallery, said undercrown surface includes a center region disposed at said center axis and between said pin bosses and said skirt sections, and said undercrown surface includes pockets disposed between said pin bosses and said ring belt region.

11. The piston of claim 1, wherein said body portion includes a ring belt region depending from said combustion surface, said body portion includes a pair of pin bosses depending from said crown and spaced from one another by a pair of skirt sections, said ferrous material of said body portion is steel or another iron-based material, said body portion extends around said center axis and longitudinally along said center axis from an upper end to a lower end, said crown presents said combustion surface at said upper end for exposure to a combustion chamber of an internal combustion engine, said combustion surface includes a combustion bowl extending toward said center axis from an outer rim and includes an apex at said center axis, said ring belt region includes a plurality of ring grooves spaced from one another by lands, said ring belt region is located at an outer diameter of said body portion and extends circumferentially about a center axis of said body portion, said pin bosses and said skirt sections extend from said crown to said lower end, said pin bosses define a pin bore for receiving a wrist pin, said coating is disposed on at least one of said undercrown surface, at least one of said ring grooves, at least one of said lands, at least one of said pin bosses, and at least one of said skirt sections, and said coating reduces chemical bonding of coking deposits on said body portion at temperatures ranging from 200 to 400° C.

12. A piston, comprising:

a body portion formed of a ferrous material, a coating disposed on at least a portion of an undercrown surface of said body portion, and said coating including a fluoropolymer, said coating including polysilane, and said coating having a thickness of 25 microns to 1 millimeter.

13. The piston of claim 12, wherein said coating further includes at least one of thermoset resin and silicone.

14. The piston of claim 12, wherein said fluoropolymer of said coating includes polytetrafluoroethylene, fluorosilane, fluorocarbon, fluoroplastic resin, and/or perfluoroplastic.

* * * * *